US009986764B2

(12) United States Patent
Watson

(10) Patent No.: US 9,986,764 B2
(45) Date of Patent: Jun. 5, 2018

(54) VAPORIZER

(71) Applicant: James Matthew Watson, Katy, TX (US)

(72) Inventor: James Matthew Watson, Katy, TX (US)

(73) Assignee: Zipline Innovations, LLC, Denver, CO (US)

( * ) Notice: Subject to any disclaimer, the term of this patent is extended or adjusted under 35 U.S.C. 154(b) by 21 days.

(21) Appl. No.: 15/285,076

(22) Filed: Oct. 7, 2016

(65) Prior Publication Data

US 2018/0098571 A1 Apr. 12, 2018

(51) Int. Cl.

| | |
|---|---|
| ***A24F 7/00*** | (2006.01) |
| ***A24F 47/00*** | (2006.01) |
| ***A24F 7/02*** | (2006.01) |

(52) U.S. Cl.

CPC ..... *A24F 47/008* (2013.01); *A24F 7/02* (2013.01)

(58) Field of Classification Search

CPC ..... A24F 7/02; A24F 47/008

See application file for complete search history.

(56) References Cited

U.S. PATENT DOCUMENTS

| | | | | |
|---|---|---|---|---|
| 9,661,878 | B2 * | 5/2017 | Liu | A24F 47/008 |
| 2013/0152922 | A1 * | 6/2013 | Benassayag | A61M 15/06 128/202.21 |
| 2014/0041655 | A1 * | 2/2014 | Barron | A61M 11/042 128/202.21 |
| 2015/0040926 | A1 * | 2/2015 | Saydar | A61M 15/00 131/329 |
| 2015/0128976 | A1 * | 5/2015 | Verleur | A24F 47/008 131/329 |
| 2015/0136155 | A1 * | 5/2015 | Verleur | A24F 47/008 131/328 |
| 2015/0150305 | A1 * | 6/2015 | Shenkal | A24F 47/008 131/329 |
| 2015/0296889 | A1 * | 10/2015 | Liu | A24F 47/008 131/329 |
| 2016/0001925 | A1 * | 1/2016 | Frazier | B65D 23/0842 215/395 |
| 2016/0286865 | A1 * | 10/2016 | King | A24F 47/008 |
| 2016/0353800 | A1 * | 12/2016 | Di Carlo | A24F 47/008 |
| 2017/0231279 | A1 * | 8/2017 | Watson | H01M 10/425 |

* cited by examiner

*Primary Examiner* — James Harvey

(74) *Attorney, Agent, or Firm* — Seyfarth Shaw LLP

(57) ABSTRACT

Disclosed is a vaporizer with a heating element located on a side opposite the mouthpiece. The heating element can heat an herbal product that is located away from the vaporizer and not within a canister that may require multiple heatings of the same product, producing a burnt flavor. The heating element can be in the shape of a coiled straw-like structure or otherwise incorporate a tubular passageway to provide better air flow during inhalation. The air flow tip and the tube can also be a single piece to allow for easier cleaning and replacement, or removal of the air flow tip if the tip includes resin of a controlled substance.

14 Claims, 5 Drawing Sheets

VAPORIZER

TECHNICAL FIELD OF THE INVENTION

The present disclosure relates generally to vaporizers. More particularly, the present disclosure relates to a vaporizer with a heating element located so as to allow for no-load use of the vaporizer.

BACKGROUND OF THE INVENTION

Vaporizers are a well-known means of smoking an herbal product. A user can press a button to heat a coil to a temperature whereby the herbal product is heated and active ingredients in the product are converted to a misty gas that the user can inhale. Vaporizers are thought to be a more healthy way of smoking the herbal product because the coil heats to a temperature sufficient to combust mainly the active ingredients without significantly combusting other parts of the product that would produce carcinogens.

Many vaporizers include loading canisters that the user loads with the herbal product prior to vaporizing the herbal product. Prior to the user inhaling, the user heats the coil to vaporize the contents of the loading canister and form a vapor. The product is therefore heated several times in the same area upon subsequent inhalations of the product due to the lack of maneuverability of the coil within the loading canister.

SUMMARY OF THE INVENTION

Conventional vaporizers are effective at vaporizing herbal products, but do not allow the user to obtain a "fresh" inhalation other than the first time the product is heated. Subsequent heatings of the product may therefore taste burnt or otherwise lack the clean flavor of the first inhalation, providing a less enjoyable experience for the user.

The present embodiments broadly comprise a vaporizer with a heating element disposed on the opposite end as the mouthpiece. The heating element can contact product located external to the vaporizer rather than requiring a loading canister that necessitates the heating of the same product multiple times, providing the burnt taste users avoid. The heating element can either surround a hollow structure or can be configured in a coiled, straw-like shape to provide better air flow during inhalation. The air flow tip and the tube can also be a single piece to allow for easier cleaning and replacement of parts, or removal of parts that include resin of controlled substances, such that the user could travel with the remainder of the vaporizer.

In particular, the present embodiments include a vaporizer including a heating element located at a first end, an air flow tip coupled to the heating element and providing structural support for the heating element, and a tube coupled to the air flow tip and extending from the air flow tip. The tube and the air flow tip are collectively removable from a remainder of the vaporizer. Further disclosed is a mouthpiece located at a second end opposite the first end, where the mouthpiece includes a mouthpiece opening. A button is operatively coupled to the heating element such that operation of the button causes the heating element to increase in heat.

Further disclosed is a vaporizer including a heating element located at a first end, an air flow tip coupled to the heating element and providing structural support for the heating element, and a tube coupled to the air flow tip and extending from the air flow tip. The tube and the air flow tip are integral with one another and collectively removable from a remainder of the vaporizer. Also included is a mouthpiece located at a second end opposite the first end, where the mouthpiece includes a mouthpiece opening. A button is also included and is operatively coupled to the heating element such that operation of the button causes the heating element to increase in heat.

Also disclosed is a vaporizer including means for heating located at a first end and means for allowing air flow, where the means for allowing air flow is coupled to the means for heating and provides structural support for the heating element. The vaporizer further includes tubular means coupled to the means for allowing air flow and extending from the means for allowing air flow, the tubular means and means for allowing air flow being collectively removable from a remainder of the vaporizer. Also included is means for receiving suction located at a second end opposite the first end, wherein the means for receiving suction includes a mouthpiece opening where a user can apply suction. In addition, the vaporizer can include means for selectively applying heat to the means for heating, where operation of the means for selectively applying heat causes the heating element to increase in heat.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
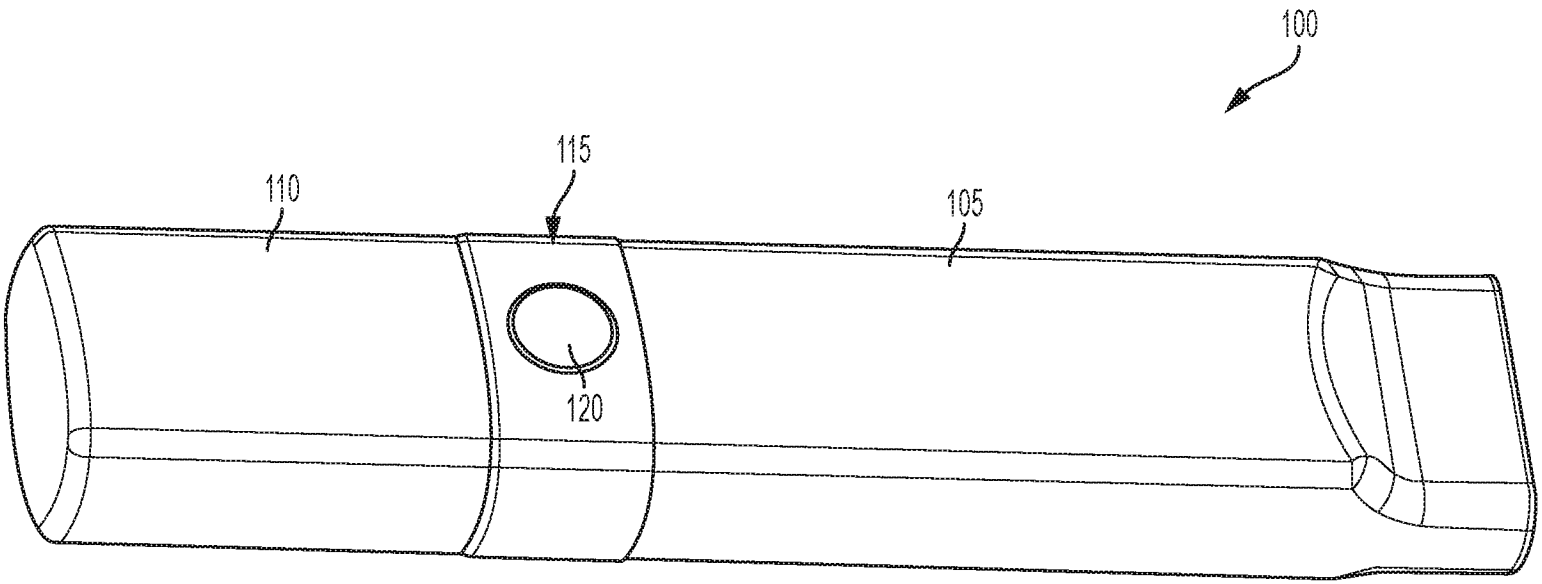
FIG. 1 is a side perspective view of a vaporizer according to the present embodiments.

While this invention is susceptible of embodiments in many different forms, there is shown in the drawings, and will herein be described in detail, embodiments of the invention with the understanding that the present disclosure is to be considered as an exemplification of the principles of the invention and is not intended to limit the broad aspect of the invention to embodiments illustrated. As used herein, the term "present invention" or variants thereof is not intended to limit the scope of the claimed invention and is instead a term used to discuss exemplary embodiments of the invention for explanatory purposes only.

The present embodiments broadly comprise a vaporizer that includes a heating element located on a first end, and a mouthpiece located on a second end opposite the first end. The heating element can contact product located outside of the vaporizer rather than requiring a loading canister that holds the product during vaporization. The end result is a product that can be freshly heated upon each inhalation to provide a fresh taste during each inhalation. The heating element can either surround a hollow tubular structure or can be structured in a coiled straw-like shape to provide better air flow during inhalation. The air flow tip and the tube can also be a single piece to allow for easier cleaning and replacement of parts.

Figure 2:
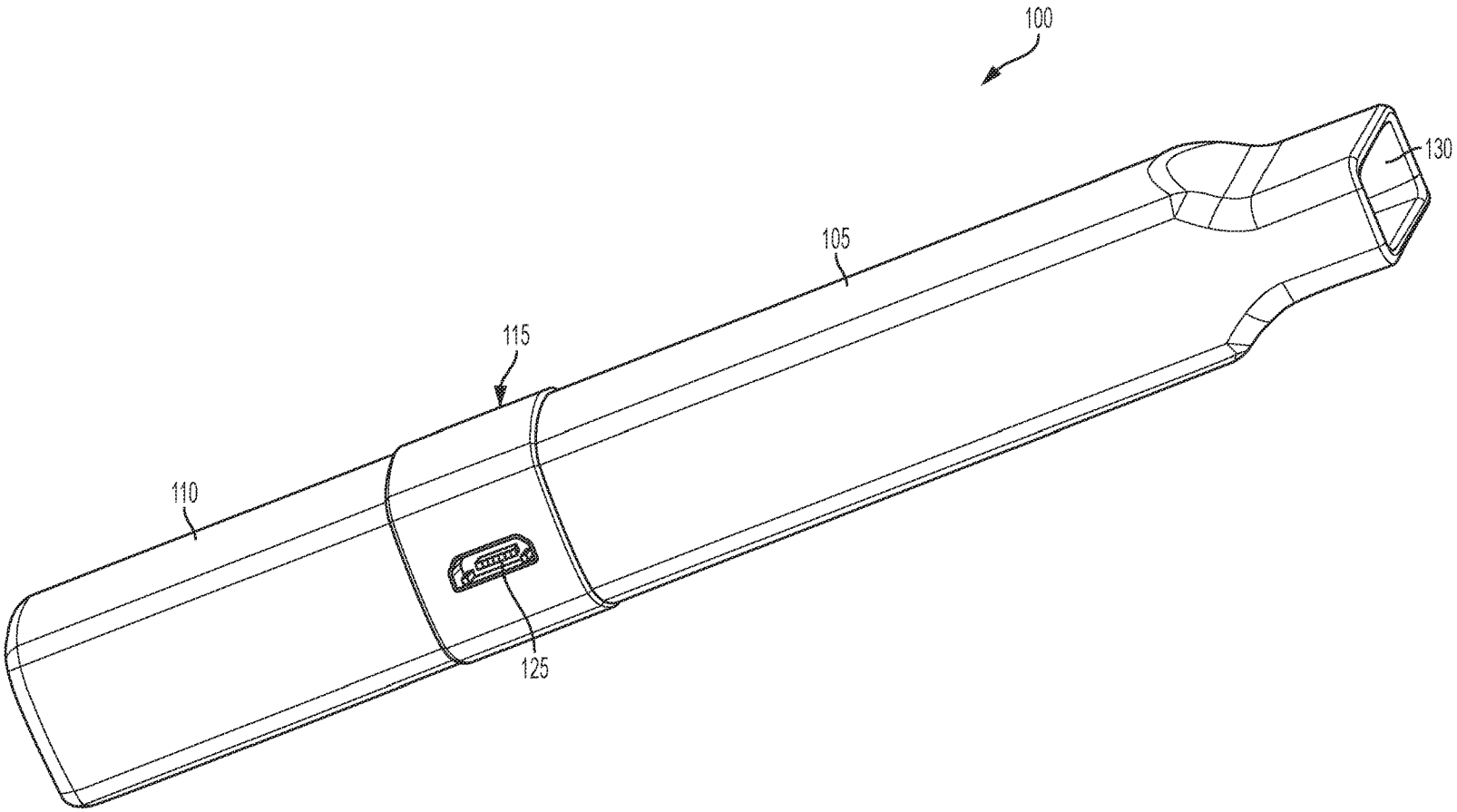
FIG. 2 is another side perspective view of a vaporizer according to the present embodiments.

As shown in FIGS. 1 and 2, a vaporizer 100 can include a body 105 and a cap 110 connected by a midsection 115. The midsection can include a button 120 that, when pressed, can activate the vaporizer 100 or heat a heating element used to vaporize an herbal product. For example, a user can press the button 120 five times can activate the vaporizer 100, and can hold the button 120 down to heat the heating element. Any other process for activating the vaporizer 100 and heating the heating element can be implemented without departing from the spirit and scope of the present embodiments.

The body 105 can house various internal components of the vaporizer 100, for example, the air flow tip and heating element and tube discussed below. The body 105 can be any shape and size without departing from the spirit and scope of the present application, and in some embodiments has the same cross sectional shape as the cap 110.

The cap 110 can be removably coupled to the midsection 115, for example, by magnetic means, or via a friction fit or other removable coupling. For example, the cap 110 can serve to enclose the mouthpiece when the vaporizer 100 is not in use.

The vaporizer 100 can be battery powered, and accordingly, can include a charging port 125 for a cord to insert into to charge the batteries of the vaporizer 100. The vaporizer 100 can also include an opening 130 at a first end of the vaporizer 100 opposite the mouthpiece where air can enter the vaporizer 100 and flow over the vaporized product to move vapor to the user when the user sucks on the mouthpiece.

Figure 3:
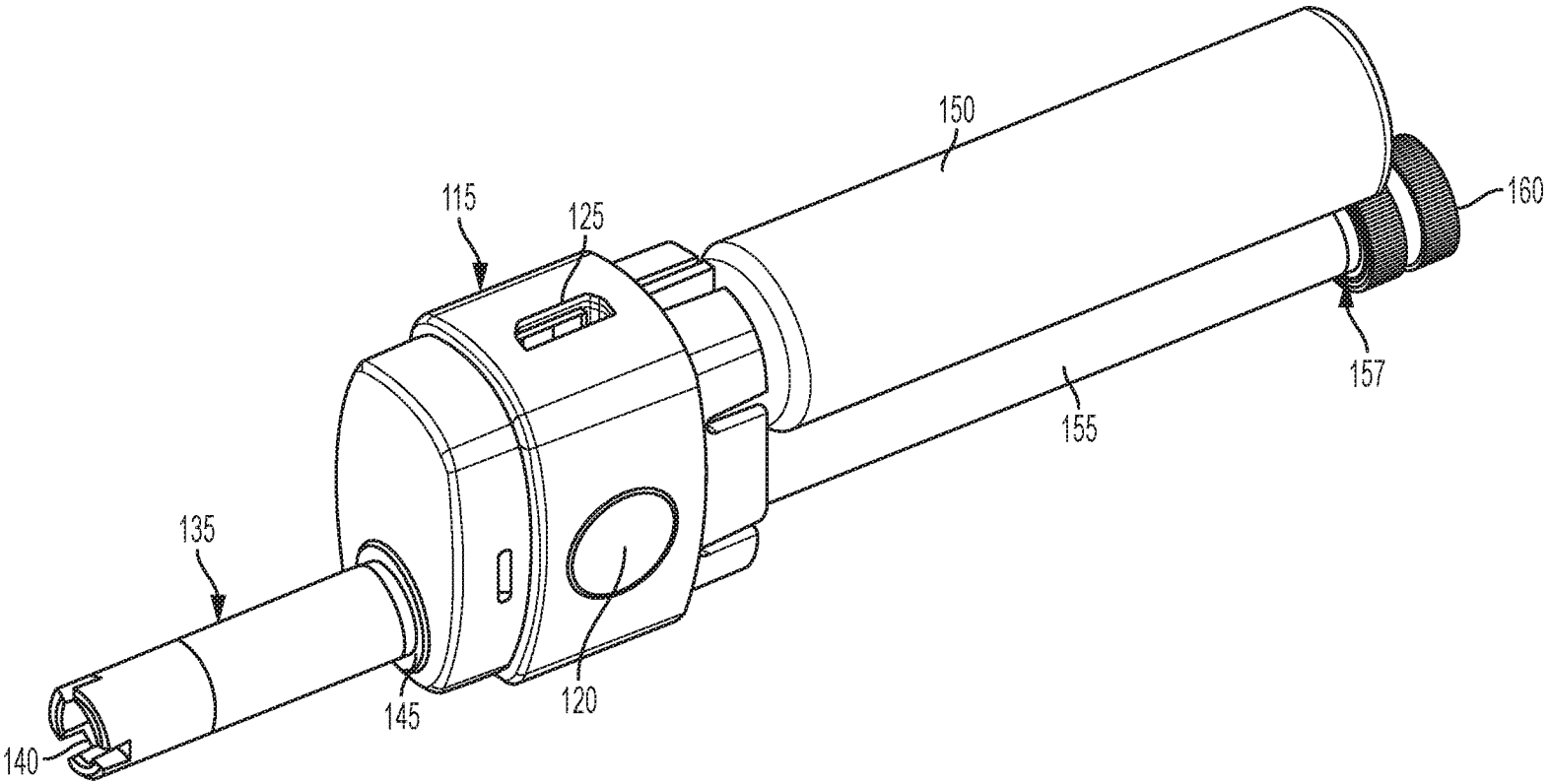
FIG. 3 is a side perspective view of the internal components of a vaporizer according to the present embodiments.
Figure 4:
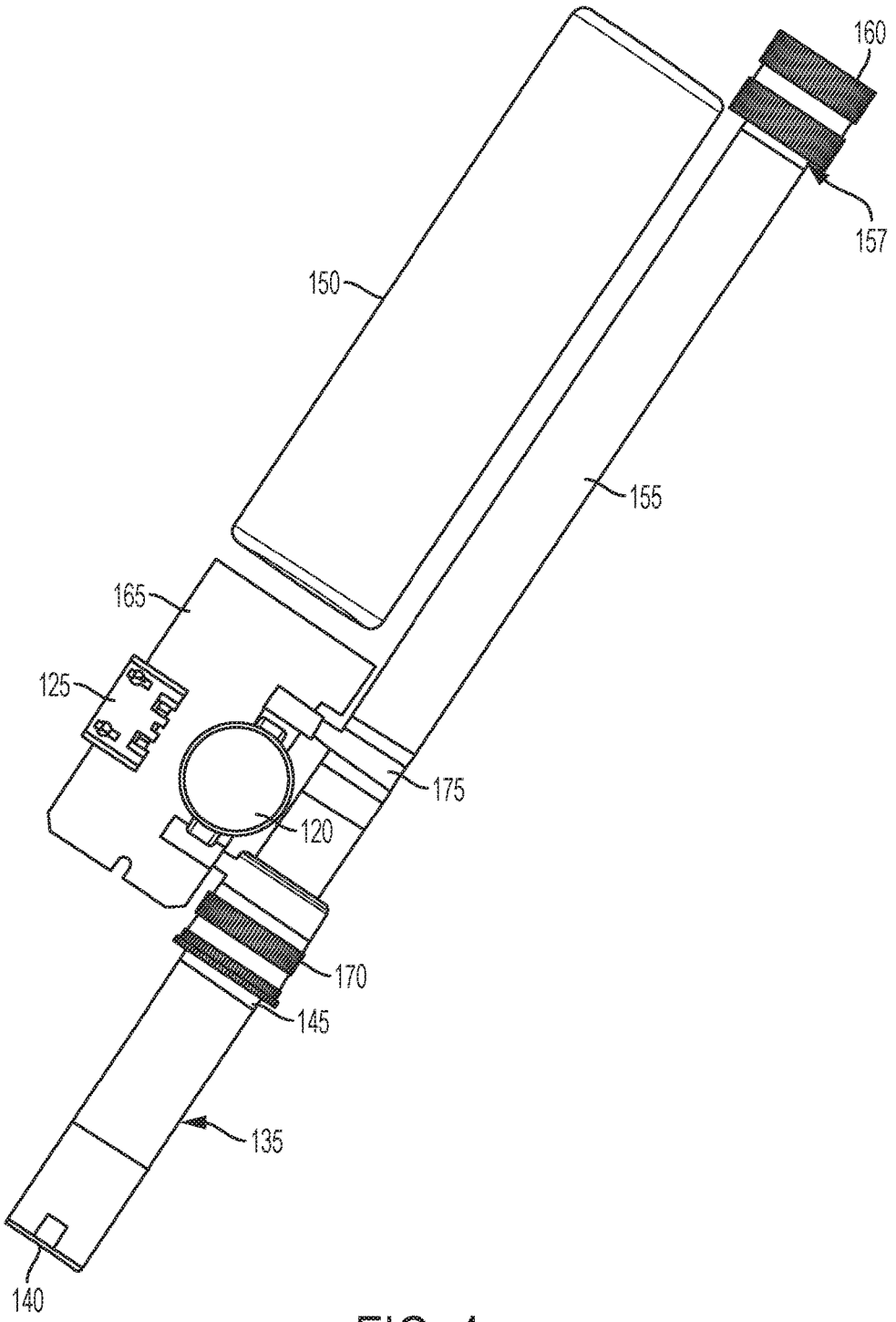
FIG. 4 is another side perspective view of the internal components of a vaporizer according to the present embodiments.

FIGS. 3 and 4 illustrate internal components of the vaporizer 100 according to the present embodiments. As shown, the vaporizer 100 can include a mouthpiece 135 with a mouthpiece opening 140 that a user can suck on to draw air through the opening 130. The mouthpiece 135 can be coupled to the midsection 115 by a gasket 145 that allows an air-tight seal between the mouthpiece 135 and the midsection 115.

The vaporizer 100 can further include a power source 150. The power source 150 can be any object capable of providing power to the vaporizer 100 to allow the vaporizer 100 to perform any function. The power source 150 can be an electrical connection to a standard or non-standard outlet, a battery, fuel cell, motorized power source, or any other source of power or electrical, magnetic, or mechanical energy. For the purposes of explanation, the power source 150 will be assumed to be a battery.

As shown, the vaporizer 100 includes a tube 155 with an air flow tip 157 having a heating element 160 on the end thereof. In some embodiments, the heating element 160 is located at a second end of the vaporizer 100 opposite a first end in which the mouthpiece 135 is located. Accordingly, a user can aim the heating element 160 at an herbal product that is located external to the vaporizer 100 and pinpoint the exact locations in which the product will be vaporized. After the first inhalation, the user can then move the product or the vaporizer 100 to contact the heating element 160 against a different part of the product. The user can therefore avoid heating the same part of the product during multiple inhalations, and enjoy a clean, "fresh" inhalation during each iteration thereof.

The heating element 160 can be a coil that is activated by pressing the button 120 to cause current to flow to the coil and therefore increase the heat of the coil. In other embodiments, the heating element 160 can be any device that produces a flame (e.g., a lighter using butane or other gas or liquid) or can be any other device that increases in heat upon the selection of a user.

It should be noted, however, that the present embodiments are not limited to the heating element 160 being located opposite the mouthpiece 135, and the heating element 160 can be located in any position. Further, the vaporizer 100 can include a loadable canister that the heating element 160 can heat herbal product within, in some embodiments. For example, the heating element 160 may be movable by the user within a loading canister, such as when a heating element 160 is positioned on a hinge or ball and socket type structure, so that the same "fresh" inhalations can be achieved with a loading canister. For the avoidance of doubt, the present invention may, in some embodiments, include a loading canister, and in other embodiments, does not include a loading canister.

The air flow tip 157 and tube 155 can be a single, integral component that is removable from the vaporizer 100 by any means. For example, the air flow tip 157 and tube 155 can be magnetically coupled, friction fit, snap fit, or connected by a detent mechanism or threaded arrangement to allow the air flow tip 157 and tube 155 to be removable as one piece. This is advantageous because the air flow tip 157 and tube 155 are typically the components of the vaporizer 100 that include the most resin from the heated product. For example, a user who smokes marijuana with the vaporizer would find marijuana resin in the air flow tip 157 and tube 155. The user can then remove the air flow tip 157 and tube 155 as a single integral device and travel with the remainder of the vaporizer 100 to areas where marijuana may not be considered legal. The integral air flow tip 157 and tube 155 can therefore act as a removable item that can be detached from the vaporizer 100 and remain in an area where marijuana is legal, while the user travels with the vaporizer 100 to an area where marijuana consumption is illegal.

The heating element 160 can be arranged in a spiral shape to allow for air flow within the center of the heating element 160 and improve flow of air from the opening 130 to the mouthpiece 135. The heating element 160 can also be structured as a coiled tube, for example, in a spiraled straw shape. This structure would also allow for better air flow while still performing the intended task of heating the herbal product.

As shown in FIG. 4, the vaporizer 100 can include a circuit board 165 that acts as the central electronic backbone of the vaporizer 100. For example, the circuit board 165 can include various data storages, integrated circuits, and processors for allowing the vaporizer 100 to function as needed. As described above, these electronics can allow the vaporizer 100 to activate upon a predetermined number of presses of the button 120, and can further cause the vaporizer 100 to heat the heating element 160 when the button 120 is held down for an extended period of time. The circuit board 165 can also be coupled to batteries that can be removable, where such batteries power the vaporizer 100 as needed. The charging port 125 can also be operatively coupled to the circuit board 165.

Also as shown in FIG. 4, the vaporizer can include a seal 170. The seal 170 can provide an airtight coupling between the mouthpiece 135 and the remainder of the vaporizer 100. In some embodiments, the mouthpiece 135 can be a threaded coupling that connects the mouthpiece 135 to the remainder of the vaporizer 100 and allows the mouthpiece 135 to be removable.

Figure 5:
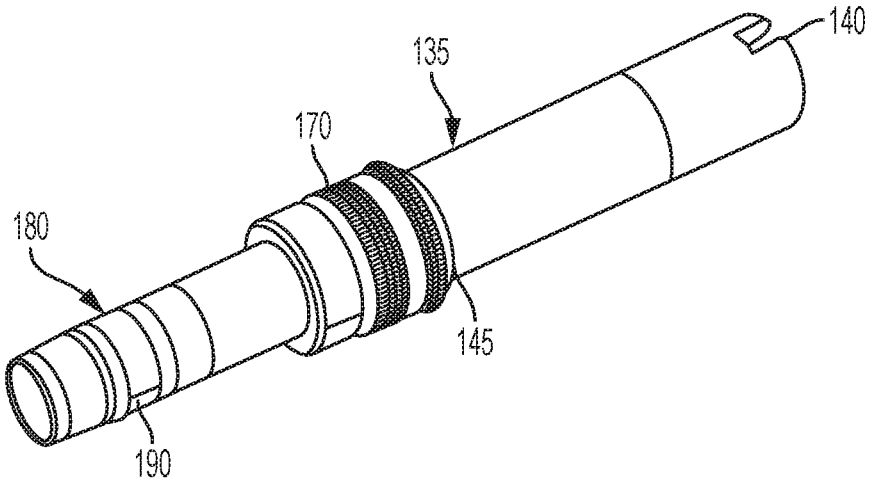
FIG. 5 is a side perspective view of a mouthpiece according to the present embodiments.

As shown in FIGS. 4 and 5, the circuit board 165 can be coupled to the tube 155, via brackets 175. The brackets 175 can be positioned on an extension 180 of the mouthpiece 135 within grooves 185. Any other manner of coupling the circuit board 165 to the remainder of the vaporizer 100 can be implemented without departing from the spirit and scope of the present application.

As discussed herein, the term "coupled" is intended to refer to any connection, direct or indirect, and is not limited to a direct connection between two or more elements of the disclosed invention. Similarly, "operatively coupled" is not intended to mean any direct connection, physical or otherwise, and is merely intended to define an arrangement where two or more elements communicate through some operative means (e.g., through conductive or convective heat transfer, or otherwise). The term "coupled" can mean, in some embodiments, two objects being integral with one another.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A vaporizer comprising:

a heating element located at a first extreme end of the vaporizer;

an air flow tip coupled to the heating element and providing structural support for the heating element;

a tube coupled to the air flow tip;

a mouthpiece located at a second extreme end opposite the first extreme end, wherein the mouthpiece includes a mouthpiece opening and wherein the tube at least partially provides an air passage between the air flow tip and the mouthpiece;

a button operatively coupled to the heating element such that operation of the button causes the heating element to increase in heat; and a housing that houses at least the button and tube, wherein the heating element is located external to the housing.

2. The vaporizer of claim 1, wherein the heating element is a coil.

3. A vaporizer comprising:

a heating element located at a first extreme end of the vaporizer;

an air flow tip coupled to the heating element and providing structural support for the heating element;

a tube coupled to the air flow tip and extending from the air flow tip, and wherein the tube at least partially provides an air passage between the air flow tip and the mouthpiece;

a mouthpiece located at a second extreme end opposite the first extreme end, wherein the mouthpiece includes a mouthpiece opening; and a button operatively coupled to the heating element such that operation of the button causes the heating element to increase in heat; and a housing that houses at least the button and tube, wherein the heating element is located external to the housing.

4. The vaporizer of claim 3, further comprising a mid-section connecting the mouthpiece to the heating element.

5. The vaporizer of claim 3, wherein the button activates the vaporizer upon being pressed a predetermined number of times, and activates the heating element upon being held for a predetermined period of time.

6. The vaporizer of claim 1, further comprising a mid-section connecting the mouthpiece to the heating element.

7. The vaporizer of claim 1, wherein the button activates the vaporizer upon being pressed a predetermined number of times, and activates the heating element upon being held for a predetermined period of time.

8. The vaporizer of claim 1, further comprising a charging port for receiving power to recharge batteries inserted into the vaporizer.

9. The vaporizer of claim 1, wherein the heating element is spiral-shaped and allows air to flow between a central portion of the spiral shape.

10. The vaporizer of claim 1, wherein the heating element is a hollow coil.

11. A vaporizer comprising:

means for heating located at a first extreme end;

means for allowing air flow, wherein the means for allowing air flow is coupled to the means for heating and provides structural support for the heating element;

tubular means coupled to the means for allowing air flow and extending from the means for allowing air flow, the tubular means and means for allowing air flow being collectively removable from a remainder of the vaporizer;

means for receiving suction located at a second extreme end opposite the first extreme end, wherein the means for receiving suction includes a mouthpiece opening whereby a user can apply suction; and means for selectively applying heat to the means for heating, wherein operation of the means for selectively applying heat causes the heating element to increase in heat; and means for housing the means for selectively applying heat and the tubular means, wherein the means for heating is located external to the means for housing.

12. The vaporizer of claim 3, wherein the heating element is structured in a hollow, spiraled tubular shape.

13. The vaporizer of claim 3, further comprising a charging port for receiving power to recharge batteries inserted into the vaporizer.

14. The vaporizer of claim 3, wherein the heating element is a coil.

* * * * *